United States Patent [19]

Tannenbaum et al.

[11] Patent Number: 4,887,464

[45] Date of Patent: Dec. 19, 1989

[54] MEASUREMENT SYSTEM AND METHOD FOR QUANTITATIVELY DETERMINING THE CONCENTRATIONS OF A PLURALITY OF GASES IN DRILLING MUD

[75] Inventors: Eli Tannenbaum, Tel Aviv, Israel; Trevor Burgess, Missouri City, Tex.; Vassilios Kalessidis; Andre Orban, both of Houston, Tex.; John Williams, Sugar Land, Tex.; Klaus Zanker, Houston, Tex.

[73] Assignee: Anadrill, Inc., Sugar Land, Tex.

[21] Appl. No.: 274,887

[22] Filed: Nov. 22, 1988

[51] Int. Cl.[4] ..... E21B 49/00

[52] U.S. Cl. ..... 73/153; 175/66; 175/206; 73/19

[58] Field of Search ..... 73/19, 151, 152, 153; 175/40, 66, 206; 210/188

[56] References Cited

U.S. PATENT DOCUMENTS

| | | | |
|---|---|---|---|
| 2,489,180 | 11/1949 | Hayward | 73/153 |
| 2,704,658 | 3/1955 | Gordon | 73/153 |
| 2,923,151 | 2/1960 | Engle et al. | 175/206 |
| 4,492,862 | 1/1985 | Grynberg et al. | 250/255 |
| 4,565,086 | 1/1986 | Orr, Jr. | 175/66 |
| 4,635,735 | 1/1987 | Crownover | 175/48 |
| 4,765,182 | 8/1988 | Boone | 73/153 |

OTHER PUBLICATIONS

Derwent Abstract for Canadian Patent Application 1,217,652.

Yamane & Yoshida, "Absorption in a Rotating Disk Gas Liquid Contractor", Journal of Chem. Engr. of Japan, vol. 5, No. 4, 1972.

D. A. White, "The Kinetics of Oxygen Absorption in an Exposed Film of Whole Blood", Chemical Engr Science, vol. 24, pp. 369–376, 1969.

Vijayraghvan & Gupta, "Thickness of the Film on a Vertically Rotating Disk Partially Immersed in a Newtonian Liquid", Ind. Eng. Chem. Fundam., vol. 21, pp. 333–336, 1982.

Marsh et al., "Subsea & Surface Well Control Systems & Procedures on the 'Zane Barns'", Offshore Tech. Conf. Paper 5627, May 2–5, 1988.

Williams & Miller, "An Instrument for On-Stream Stripping and Gas Chromatographic Determination of Dissolved Gases in Liquids", Anal. Chem., vol. 34, No. 6, 1962.

B. O. Pixler, "Formation Evaluation by Analysis of Hydrocarbon Ratios", J. of Petr. Techn., p. 665, Jun. 1969.

B. O. Pixler, "Mud Analysis Logging", J. of Petr. Tech., pp. 323–326, Apr. 1961.

*Primary Examiner*—Michael J. Tokar
*Assistant Examiner*—Kevin D. O'Shea
*Attorney, Agent, or Firm*—Stephen L. Borst; David P. Gordon

[57] ABSTRACT

A system for the quantitative analysis of one or more evolving gases exiting a borehole includes a Venturi ejector for substantially capturing liberated gases in the bell nipple and return line, a rotating disk extractor for substantially extracting gases entrained and dissolved in drilling mud, and a gas analyzer system for analyzing and quantifying the captured and extracted gases. The Venturi ejector preferably is operatively coupled to the return line, and a pipe wiper may be arranged to partially cover the bell nipple. The ejector sucks liberated gases out of the return line and causes a negative pressure to occur at the bell nipple such that air is sucked into the bell nipple rather than exiting the same. The rotating disk extractor has air flowing countercurrent to the mud flow. As the disks rotate, they pick up a thin liquid film of mud which is exposed to the air stream. Dissolved hydrocarbon gas in the thin film evaporates, and entrained bubbles break resulting in the gases entering the air stream which is passed through a liquid trap out to a gas analyzer. By knowing the rate of air flow through the ejector and the extractor, the rate of mud flow through the system and through the extractor, and the gas compositions as determined by the gas analyzer, the quantitative components of the different gases in the mud are found. Also, with known rates, the gas flows may be combined in a proper ratio to provide a single representative gas stream.

23 Claims, 2 Drawing Sheets

MEASUREMENT SYSTEM AND METHOD FOR QUANTITATIVELY DETERMINING THE CONCENTRATIONS OF A PLURALITY OF GASES IN DRILLING MUD

BACKGROUND OF THE INVENTION

1. FIELD OF THE INVENTION

This invention generally relates to well logging during drilling. The invention more particularly concerns a system and method for determining, while drilling, the concentrations and amounts of one or more different gases in drilling mud returning from the borehole.

2. DESCRIPTION OF THE PRIOR ART

In the drilling of an oil or gas well (the terms "borehole" and "well" being used interchangeably herein), a drill bit is mounted on the end of an elongated rotating drill string which turns the bit and causes it to cut away the underlying earth and rock formations. During this operation, a drilling mud is continuously pumped down through the drill string and into the region around the drill bit and then back up the borehole annulus to the surface. This drilling mud is typically made up of clays, chemical additives and an oil or water base and performs several important functions. The mud cools and lubricates the drill bit, carries drill cuttings back up out of the well, and serves to maintain a hydrostatic pressure which prevents pressurized fluids in the earth formation from blowing out through the drilled well.

During the drilling of a well, various measurements may be taken both of the drilling mud entering the drill string and returning to the surface and of other parameters as determined by tools at or near the drill bit. The measurements at or near the drill bit are typically called measurements while drilling ("MWD") and provide a log of the drilling operations from which one may attempt to analyze the earth formations which the drill bit is penetrating. These logs are important as they enable the drilling operator to ascertain the presence of oil or gas in the formation being drilled. Mud logging measurements, including temperature, electrical conductivity, pH, sulfide ion content and oxidation-reduction potential of the drilling mud returning from the well may also be made. In addition, measurements may be made on the returning mud to ascertain total hydrocarbon content and to ascertain the presence of certain specific gases such as carbon dioxide and hydrogen sulfide in the mud. The gas content of the mud may serve as an indicator of the pore pressure of the drilled section, and if properly determined can be used to identify "oil shows" and "pay zones".

In analyzing the hydrocarbon content of the mud, several techniques have been used. Gas is typically extracted from the mud by mechanical agitation in a gas trap which is located in the possum belly tank (also called "header tank"). The extracted gas is analyzed for "total gas" by one or more of several different detectors such as a catalytic combustion detector (CCD) apparatus, thermal conductivity detectors (TCD), and flame ionization detectors (FID). Separation and quantification of the different light hydrocarbon (i.e. methane through pentanes) gases are then typically carried out via gas chromatography techniques with similar or different detectors. Because chromatography techniques require several minutes for analysis, the gas content of the mud is determined for batch samples taken at discrete intervals of several minutes apart. However, as disclosed in U.S. Pat. #4,635,735 to Crownover, and assigned to the assignee herein, it has been determined that spectrographic analysis of separated gases permits a continuous analysis of the gas content of the mud. In U.S. Pat. #4,635,735, at least a portion of the drilling mud returning from the well is subjected to gas separation in a mud/gas separation means. The separated gas is then subjected to analysis in a gas spectral analyzing means (spectrophotometers) to produce a gaseous component concentration signal whose value at any instant represents the concentration at that instant of the given gaseous component in the separated gas. By also monitoring the flow rate of the returning mud through the separation device, and the flow rate of the separated gas, a continuous determination is made of the concentration of the given gaseous components in the drilling mud. In accord with another aspect of U.S. Pat. #4,635,735, the drilling mud is passed through an agitating type mud/gas separation device while a carrier gas is simultaneously flowed through the mud/gas separation device. The carrier gas is thoroughly mixed in the mud/gas separation device. The resulting mixture of carrier gas and mud gas is separated from the mud in the separation device and is subjected to analysis in a gas analyzer to produce a component gas signal whose value corresponds to the concentration of the component in the gas mixture. By measuring the carrier gas volume flowing into the mud/gas separation device, the flow rate of the mud into the separation device, and the component gas signal, a continuous concentration signal representing the concentration of the component gas in the drilling mud may be obtained.

Despite the advances in the art in obtaining continuous determinations of the concentrations of different gases evolving from the formation, the inventors herein have determined that the final results of all current techniques whether using continuous or batch analyses are flawed due to the sampling and extraction methods utilized in obtaining the analyzed gases. In particular, the inventors have found that the gases obtained by the present techniques may not be representative of the relative gas concentrations evolving from the formation, as large amount of the lighter, more volatile gases (e.g. low carbon numbers) which are more typically found as gas bubbles in the mud may be lost at the bell nipple. In addition, the gases which are finally extracted from those that remain in the mud are also extracted as a function of their solubility and volatility (carbon number) due at least partly to the fractionation processes between individual hydrocarbons that takes place during transport to the surface. As a result, in many situations only a small proportion of the gas evolving from the formation may actually be measured by the known measurement techniques, and the measured portion is not representative of the gas composition of the formation.

SUMMARY OF THE INVENTION

It is therefore an object of the invention to provide a system which will sample substantially all of the volatile constituents evolving from a well.

It is a further object of the invention to capture substantially all of the gases evolving from a well by suction and extraction techniques.

It is another object of the invention to provide a system and method which analyze and provide quantitative determinations of at least the various hydrocarbon gases evolving from a well.

In accord with the objects of the invention, a system for the quantitative analysis of a plurality of evolving gases exiting a borehole comprises means for substantially capturing liberated gases in the bell nipple and return line, extraction means for substantially extracting gases entrained and dissolved in drilling mud, and means for analyzing and quantifying the captured and extracted gases. Preferably, the gas capturing means comprises a Venturi ejector (or jet pump) located in a line attached to the top of the return line. A pipe wiper or similar device which partially covers the bell nipple may also be installed. The ejector sucks liberated gases out of the return line and causes a negative pressure to occur at the partially covered bell nipple such that ambient air is sucked into the bell nipple rather than gases exiting the same. The extraction means is preferably a rotating disk extractor having air flowing countercurrent to the mud flow. As the disks rotate, they pick up a thin liquid film of mud which is exposed to the air stream. The dissolved hydrocarbon gases in the liquid as well as any hydrocarbon bubbles which break enter the air stream and are passed through a liquid trap out to a gas analyzer.

The means for analyzing the captured gases may comprise at least one FID chromatograph, although other devices, including continuous analyzers may be used. In determining the quantities of the different gases evolving from the formation, the mud flow rates through the return line and through the extractor, and the air flow rates through the ejector and extractor must be measured. Knowledge of the mud and air flow rates may also be used to combine the gas streams exiting the ejector and the extractor in proper ratios so that only one analyzer means is required to determine gas quantities.

Other objects, aspects, features, and advantages of the invention will become apparent to those skilled in the art upon reference to the following detailed description of the invention and the accompanying drawings.

DETAILED DESCRIPTION OF THE PREFERRED EMBODIMENT

Figure 1:
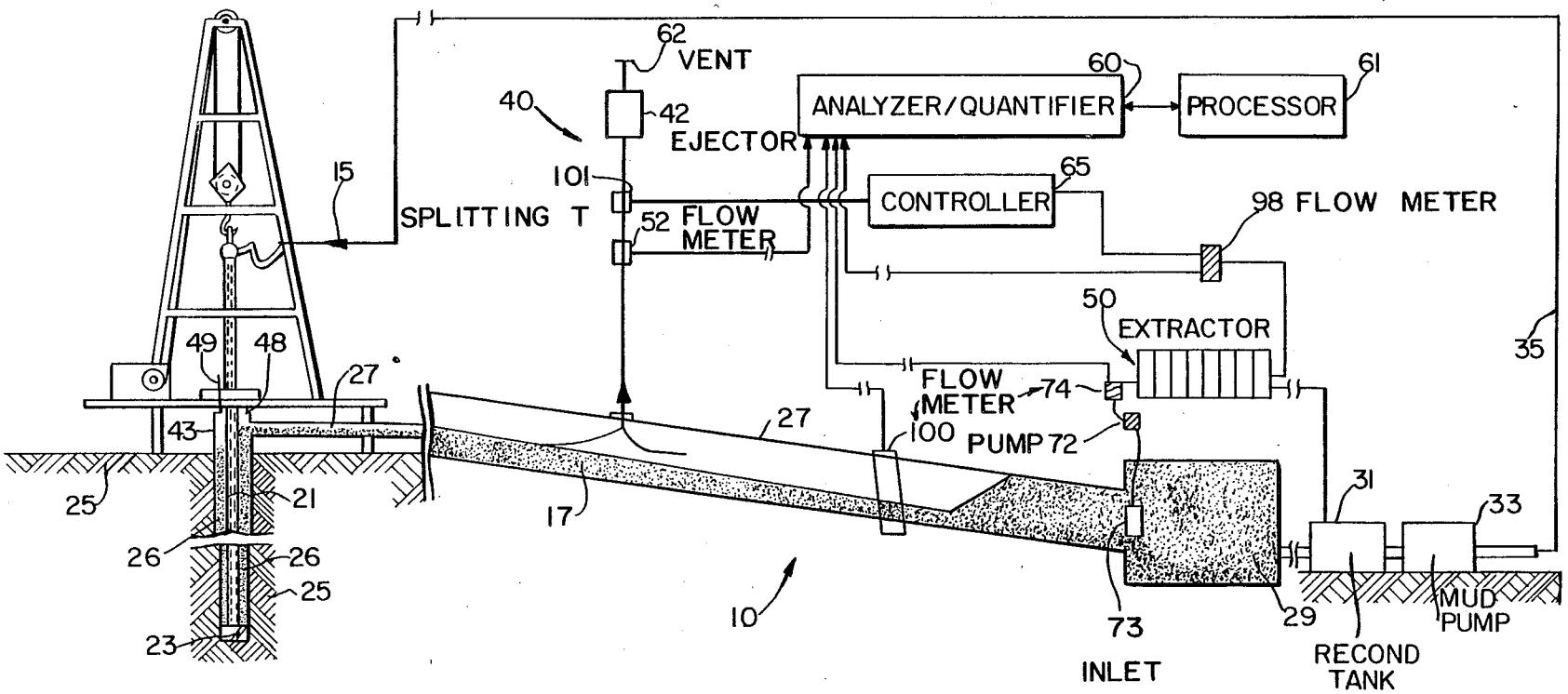
FIG. 1 is a diagrammatic view, partially in blocks, of the preferred measurement system of the invention.

Turning to FIG. 1, the measurement system 10 of the invention is seen in conjunction with a standard mud flow system for borehole drilling. The mud flow system comprises a source 15 of mud 17, which is pumped by pump 33 through a drill string 21 to a drill bit 23 drilling earth formation 25. The mud cools the bit 23 while exiting therethrough and circulates back towards the formation surface in an annulus 26 created between the outside the drill string 21 and the earth formation 25. At the formation surface, the mud 17 exits the borehole annulus via a return line 27 which connects the borehole to a possum belly 29. The mud is then processed as desired in a reconditioning tank 31 and may be recycled back to mud source 15 via mud pump 33 and recycling line 35.

The measurement system 10 basically includes a liberated gas capture means 40 for capturing a substantial amount (from 80-100%) of the liberated gases both in the return line 27 and in the bell nipple 43 atop the borehole, an extraction means 50 for extracting a substantial amount (from 60–100%) of the gases dissolved and entrained in drilling mud which enters the extractor, and an analyzer and quantifier means 60 for analyzing the captured and extracted gases and quantifying the same. As will be described in more detail hereinafter, in order to properly quantify one or more gases captured and extracted, knowledge of various gas flows through the ejector means 40 and extractor means 50 must be known. Further, in order to quantify the gases in terms of amount of gas per volume of mud, the mud flow rates through the return line (or borehole) and through the extractor means 50 must be known.

Figure 2:
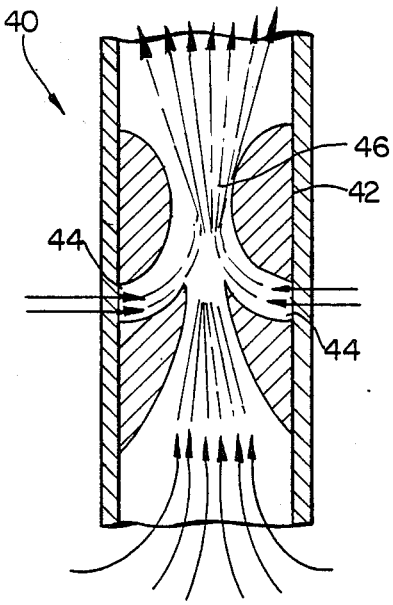
FIG. 2 is a cross-sectional view of the preferred Venturi ejector gas capture means of the invention.

Preferably, the gas capturing means 40 comprises a Venturi ejector 42 located in a line which is attached atop an enclosed return line 27 at a location where mud does not fill the return line. As indicated in FIG. 2, and as will be appreciated by those in the fluid dynamic arts, by forcing air through the Venturi ejector air intake ports 44, an area of low pressure is created in the Venturi throat 46. According to the preferred embodiment, the pressure in throat 46 is controlled to cause a subambient pressure to occur at the bell nipple 43 such that air is sucked into the bell nipple rather than gases exiting from the same. In this manner, all liberated gas (from bubbles or evaporation) which would have otherwise exited through the bell nipple 43 are captured. Likewise, all gases evolving out of the mud in the enclosed return line 27 are sucked through the throat 46 of ejector 42. It should be noted, that in order to maintain high efficiency of the ejector 42 when a large diameter bell nipple is in use, a partial cover or pipe wiper 48 may be placed over the bell nipple 43 thereby more effectively maintaining a low pressure on the return line side of the bell nipple. Also, if desired for safety purposes, a gas sensor 49 may be located above the bell nipple 43. The gas sensor 49 serves to monitor the gas concentrations and can give advance notice of possible dangerous gas levels.

In accord with one aspect of the invention, the captured gas and the air sucked by and towards ejector 42 are measured by a flowmeter 52. A portion of the air/gas mixture is then conducted to the gas analyzer/quantifier means 60, while the remaining gas is exhausted via ejector 42 through vent 62 to a safe location. If desired, in accord with another aspect of the invention, prior to the air/gas mixture being sent to analyzer/quantifier 60, the air/gas may be mixed by a flow-controller 65 with air/gas exiting from extractor 50, as will be discussed below in detail.

As previously indicated, drilling mud 17 flowing through return line 27 towards possum belly 29 contains entrained gas in the form of gas bubbles and dissolved gases. Because the gases captured via the ejector 42 are not representative of the distribution of gases leaving the earth formations, and because it is desirable to obtain a quantitative indication of those gases, it is desirable to extract the entrained and dissolved gases from the drilling mud 17. Thus, a pump 72 is utilized to pump the mud 17 at a measured rate into the extractor means 50, and a mud flowmeter 74 is used to measure the mud flow rate into the extractor. With knowledge of the flow rate (volume/time) of mud into the return line (or drill string), and a knowledge of the flow rate of mud into the extractor 50, the percent mud entering the extractor is easily determined.

Figure 3:
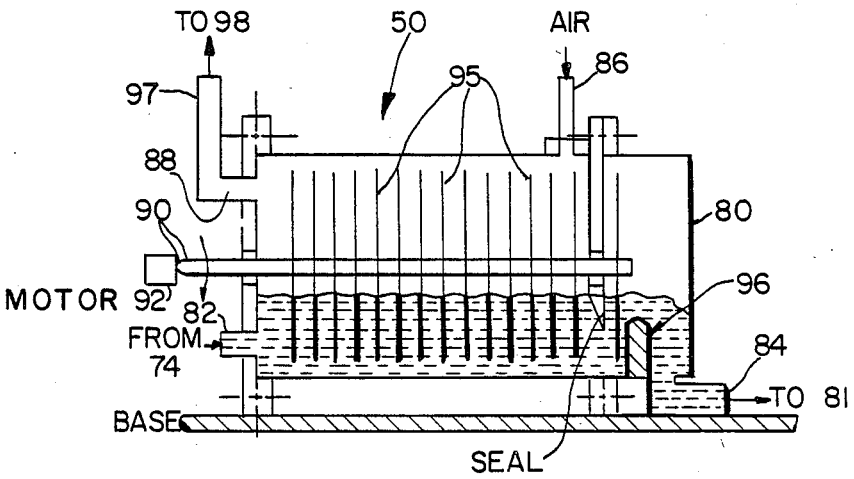
FIG. 3 is a cross-sectional view of the preferred extraction means of the invention.

Turning to FIG. 3, the details of the preferred extraction means of the invention are seen. Extraction means 50 is generally based on a design used in water analysis and reported by Williams and Miller in *Analytical Chemistry,* Vol. 34 pp. 657–9 (1962). The extraction means 50 preferably includes an enclosed cylindrical tank 80 having a mud inlet 82 from possum belly 29, and a mud outlet 84. Tank 80 also has an air inlet 86 and an air/gas outlet 88. Extending through tank 80 is a shaft 90 which is rotated by the aid of a motor 92. Attached to the shaft are a plurality of metal or plastic disks 95. A weir 96 is located at the mud outlet end of the tank 80 and provides control of the mud level in the tank 80. As the mud flows slowly through the tank 80, the shaft rotates the disks which pick up a thin liquid film while passing into and out of the mud stream in the lower part of the tank. The thin liquid film is exposed to an air stream which flows countercurrently to the mud flow; the air entering via air inlet 86. With the provided arrangement, a mass transfer takes place very rapidly from the phase that is rich in the gas to be extracted (i.e. the mud) to the lean phase (i.e. the air). Also, when the drilling mud contains small hydrocarbon gas bubbles, the bubbles are lifted together with the liquid film on the surface of the disk. As the bubbles are exposed to air, they break and transfer their hydrocarbon gases to the air stream. Regardless of the mechanism of the gas transfer, the rotating disk extractor is extremely effective in extracting the gases in the mud. The air/gas mixture is then passed through a water trap 97 to remove any mud particles or condensed water which might have become entrained in the air/gas flow, and then sent (via flow-controller 65 if desired) to the gas analyzer/quantifier 60. As with the air/gas mixture from the ejector 42, the air/gas mixture flow rate from the extractor 50 is preferably measured by a flow meter 98 so that a quantitative analysis of each gas component may be obtained.

While the extractor 50 of the invention is excellent in extracting gases from the mud, additional efficiency can be gained by operating the extractor according to one or more of the following manners. A high vacuum can be applied to the extractor by placing an air restrictor at the air inlet 86. With a resulting large pressure difference, the gases in the mud are more easily evporated into the air stream. Another manner of expediting such evaporation is to operate the extractor 50 at high temperatures. Alternatively, air may be injected into the extractor through the shaft 90 of the extractor as aeration would increase due to the more thorough replacement of the air in contact with the the liquid film on the disks. Or, if desired, air could be injected on the surfaces of the disks 95, thereby rotating the disks as well as sparging clean air through the liquid mud. Such an arrangement would likewise increase the mass transfer from the mud to the air.

Once the gases are captured or extracted, they must be analyzed to determine their composition. While the means for such an analysis is preferably a gas chromatograph equipped with a flame ionization detector for hydrocarbon gases, it will be appreciated that any means for analyzing the gas mixture composition could be utilized. The relative composition results of the flame ionization detector means, however, while valuable for certain purposes, is not the primary focus of the instant invention. Rather, quantitative determinations of the concentration of gases brought to the surface with the drilling mud (e.g. cc gas/liter mud) are desired for the plurality of different gases evolving from the formation. Where the analysis means provides determinations of particular gases as percentages of the total analyzed gas such as in a flame ionization detector, in order to determine the quantity per unit time (i.e. flow rate) of each particular gas component, the flow rate of the total air/gas mixture under consideration must be known. Hence, the afore-mentioned flowmeters 52 and 98 are utilized for this purpose in conjunction with the FID analyzers. Of course, if the analyzer could provide volume determinations rather than relative percentages, the use of flowmeters could be obviated.

As shown in FIG. 1, the gases captured by the ejector 40 and extracted by the extractor 50 may be mixed prior to being analyzed by a single FID analyzer. The mixing of the gases is controlled by controller 65, and can be controlled according to the following principles.

The hydrocarbon gas concentration in the original mud can be determined by analyzing the air/gas streams (hereinafter referred to as "air streams") exiting the capture means flow meter 52 and the extractor means 50 and calculating their relative contributions according to the flow rate data as follows. If a light hydrocarbon i is present in the captured gases being sucked by ejector 40 as composition mole fraction $Y_i$, and if the rate of air flow ("air flow" being representative of the flow of an air/gas mixture; air being introduced via the bell nipple) measured by flowmeter 52 is $F_{ac}$, the volume of the individual hydrocarbon i flowing during time t will be $Y_iF_{ac}t$. Of course, this is true for all gas components whether i is indicative of methane, propane, butane, hydrogen sulphide, etc. Similarly, if component i is present with composition mole fraction $Z_i$ in the extractor exit air stream, the quantity extracted from the mud stream in time t will be $Z_iF_{ae}t$, where $F_{ae}$ is the extractor air flow rate as measured by flowmeter 98.

Because the extracted gases exiting the extractor 50 represent hydrocarbons extracted from only a small sampled segment of the mud $F_s$ (as opposed to the captured gases of the ejector which represent hydrocarbons associated with the entire mud flow $F_m$), in order to determine the total amount of gaseous hydrocarbons present in the mud entering the possum belly, the extracted quantity $Z_iF_{ae}t$ must be multiplied by $F_{m/Fs}$. Then, the total quantity $Q_{t,i}$ of hydrocarbon gas component i in the mud will be determined as $$Q_{t,i}=Y_iF_{ac}t+Z_iF_{ae}t\ (F/_m/F_s) \quad (1)$$

Since this total is the gas quantity from a certain amount of mud volume $F_mt$, the concentration of component i in the borehole mud per volume mud is expressed as $$C_i=Y_iF_{ac}/F_m+Z_iF_{ae}/F_s \quad (2)$$

Where significant amounts of hydrocarbon gases are present as liberated gas at the surface, the first term of expression (2) will dominate, while where lower concentrations of gas are present, they are usually present primarily as dissolved and entrained gas, and the second term will dominate.

Because the quantity of gas in the mud is only accurately determinable as a function of the detected gas in two separate air streams, one manner of making such determinations is by having a gas analyzer for each stream. However, as suggested above, by using a controller to combine the two streams in the proper proportions, namely a volume $F_{ac}/F_m$ of ejector stream with a volume $F_{ae/Fs}$ of extractor stream, a single analyzer may be used. The composition of the air stream so mixed will be the weighted average $W_i$ of its two components $Y_i$ and $Z_i$. Thus, and $Z_i$. Thus, $$W_i = \frac{Y_i F_{ac}/F_m + Z_i F_{ae}/F_s}{(F_{ac}/F_m) + (F_{ae}/F_s)} \quad (3)$$

Comparing expressions (2) and (3), it is quickly recognized that the volume of component i per volume mud may be expressed in terms of $W_i$ as $$C_i = W_i((F_{ac}/F_m)+(F_{ae}/F_s)) \quad (4)$$

In practice, only one of the air streams (preferably from the capture means ) needs to be split as the combined factor $F_{ac}F_s/(F_mF_{ae})$ can be used. Thus, expression (3) may be rearranged accordingly to represent the mixing of $F_{ac}F_s/(F_mF_{ae})$ volumes of air from the capture means with one volume of extractor air:

$$W_i = \frac{\{Y_i F_{ac}F_s/(F_mF_{ae}) + Z_i\}}{\{F_{ae}F_s/(F_mF_{ae})) + 1\}} \quad (5)$$

In general, any consistent set of units can be utilized with the provided expressions as no units have been specified (cubic feet being chosen as a likely practical unit for volume of air flow). The final units for the concentration of the gas in the mud depends on the units used for the mud flow as well as for the air flow measurements.

While the combination of air streams in accord with the discussion above provides the advantage that only a single stream need be analyzed by the analyzer 60, the disadvantages are that the stream must be split according to flow rate factors. While the air flow rates $F_{ac}$ and $F_{ae}$, and the mud sampling rate $F_s$ should be relatively constant, the mud flow rate $F_m$ can vary. Thus, the mud flow rate is preferably monitored by a flow meter 100 in the return line, and the flow-controller should be capable of controlling the flow from a splitting tee 101. A further disadvantage of combining the air streams is that there might be a time lag between the two air streams coming from the same volume of mud. However, proper duct length sizing could reduce this complication.

While the measurement system aforedisclosed provides an excellent quantitative determination of gases in a drilling mud, additional refinements such as calibration and/or interpolation may be utilized to provide still better results. For example, FID chromatographs are typically batch devices which provide analysis results at discrete time periods rather than continuously. Where drilling is accomplished at moderate rates (e.g. 60 ft/hr), a typical chromatograph will produce an analysis for every four feet of drilling. To overcome data gaps in the log output, an interpolation technique may be utilized. With known total hydrocarbon signals TH1, TH2, and TH3 at times t1, t2, and t3 (the total hydrocarbon signals being available continuously according to techniques known in the art), the concentration $y_i2$ of component i at time t2 may be determined as:

$$y_i2 = TH2\{(y_i1/TH1) - [(y_i1/TH1) - (y_i3/TH3)](t2-t1)/(t3-t1)\}$$

where $y_i1$ and $y_i3$ are the concentrations of component i at times t1 and t3 respectively as determined by the chromatograph. This interpolation ensures primary dependence on the total hydrocarbon reading while correcting for the effects of changes in the relative component concentrations on the total hydrocarbon readings at the two analysis points.

While the interpolation technique permits a continuous log to be provided in the absence of continuous outputs from the gas analyzer, a calibration technique may be used to provide additional accuracy where 100% of the evolving gases are not captured or extracted by the ejector and extractor. While the use of an ejector and extractor permits a substantial amount of the evolving gases to be captured and analyzed, it will be appreciated that 100% efficiency may be approached but is rarely obtained. Thus, any of several "calibration" techniques may be utilized to correct for any inaccuracies which result from anything less than a substantially complete capture. A first technique is the use of a separate correction factor for each hydrocarbon gas (or other gas) component. Each correction factor may be an average determined from experimental results. For example, it may be determined that on the average, ninety-four percent of a first particular hydrocarbon gas is captured while ninety-eight percent of a second particular hydrocarbon gas is captured. In correcting for the same ("calibration" in a broad sense), the results of the quantitative determinations output by the analyzer would be multiplied by respective factors of 1/0.94 and 1/0.98 to arrive at a corrected determination.

A second technique for compensating for the capture of less than substantially all the gas is the provision of correction factors for each gas component calculated from a model which accounts for several variables. Thus, variables such as mud properties, temperature, relative gas quantities, etc., may be considered in providing a correction factor for the quantitative determinations. Then, using a processor such as processor 61 associated with the analyzer/quantifier, a more accurate determination of gas quantities may be obtained. In fact, the relative efficiencies of the ejector and extractor may also be taken into account if desired by the multivariate model. Similarly, a third preferred compensation technique would be the provision of correction (calibration) factors which are based on actual calculations of system efficiencies taken under various conditions. Having compiled a data base of correction factors for the various gases under the various conditions, the quantitative determinations of the analyzer/quantifier could be adjusted appropriately.

There has been described and illustrated herein a system for the quantitative determination of gases in a drilling mud. While particular embodiments have been described it is not intended that the invention be limited thereto as it is intended that the invention be as broad in scope as the art will allow. Thus, those skilled in the art will appreciate that while particular means for capturing the liberated gases, means for extracting entrained and dissolved gases, and analyzing means were described, other such means could be utilized providing a substantial percent of the gases exiting the formations are captured and extracted and providing a determination of the gases that are being captured and extracted may be had. Indeed, any of several analyzing (measurement) schemes including that disclosed in U.S. Pat. #4,635,735 could be utilized in conjunction with the system of the invention. Similarly, while no particular means were specified for calculating the final determinations of volume gas in the mud, it will be appreciated that many such tools such as computers, processors, or dedicated hardware could be utilized to accomplish the same and could be part of or associated with the analyzer/quantifier means. In fact, various calculations and/or logs could be had, including but not limited to total hydrocarbon gas content in the mud, individual hydrocarbon gas contents, total light (up to and including C4) and total heavy (over C4) hydrocarbon gas content, etc. Also, while hydrocarbon gases where the primary target of the specification, it will be appreciated that concentrations of other gases such as $H_2S$ and $CO_2$ could likewise be obtained using an appopriate analyzer in the disclosed system with appropriate correction for any levels of the gas found in the ambient air entering the capture means or extractor (e.g. $CO_2$).

It will further be appreciated by those skilled in the art, that data and/or control lines between the various flowmeters and valves and the analyzing and/or quantifying means would be required to control the system and to determine the quantity of gases in the drilling mud. While these communication lines are not shown in the Figures, those skilled in the art should have no trouble in providing for the same. Likewise, those skilled in the art will appreciate that the method invention for obtaining a substantial amount of the gases exiting the formation is very closely related to the system invention, and that the method pertaining to providing a single representative air/gas stream for quantitative measurement relates closely to the flowmeters, controlling valves, and provided calculation or quantifying means. Therefore, it will be apparent to those skilled in the art that other changes and modifications may be made to the invention as described in the specification without departing from the spirit and scope of the invention as so claimed.

We claim:

1. A system for quantitatively analyzing gases exiting a borehole with drilling mud, wherein at least some of said gases exit as liberated gases and some of said gases exit as at least one of entrained and dissolved gases in said drilling mud, said drilling mud exiting said borehole via a substantially enclosed return line located adjacent a bell nipple atop said borehole, said system comprising:

(a) gas capturing means for capturing a substantial amount of said liberated gases in said bell nipple and said return line;

(b) gas extraction means for receiving at least some of said mud traversing said return line, and for extracting a substantial amount of said gases entrained or dissolved in said at least some drilling mud;

(c) at least one gas analyzing means for receiving said captured liberated gases from said gas capturing means and said extracted gases from said gas extraction means and for analyzing said extracted gases to provide a quantification of said gases exiting said borehole.

2. A system according to claim 1, wherein:

said at least one gas analyzing means comprises means for analyzing and quantifying at least one gas exiting said borehole, including at least one of a plurality of different hydrocarbon gases.

3. A system according to claim 1, wherein:

said gas capturing means comprises means for causing pressure at an atmospheric opening of said bell nipple to be less in said bell nipple than the pressure outside said bell nipple.

4. A system according to claim 3, wherein:

said gas capturing means comprises a Venturi ejector operatively coupled to said return line, wherein said Venturi ejector includes means for pulling air through said Venturi ejector so as to create said pressure at said atmospheric opening of said bell nipple and cause said liberated gases to enter said Venturi ejector.

5. A system according to claim 4, wherein:

said gas capturing means further comprises a covering means for at least partially covering said bell nipple.

6. A system according to claim 1, wherein:

said extraction means comprises a rotating disk extractor means including means for obtaining said at least some of said mud at a point along or after said return line means where said liberated gas has been substantially captured by said gas capturing means.

7. A system according to claim 6, wherein:

said rotating disk extractor means comprises a substantially enclosed tank having a mud inlet coupled to said return line, a mud outlet, an air inlet, an air/gas outlet, a rotatable shaft, a plurality of disk means on said rotatable shaft for providing a surface onto which said mud may form a mud film which can be contacted by air entering from said air inlet, wherein a mixture of said extracted gases and said air exit said air/gas outlet to said at least one gas analyzing means.

8. A system according to claim 7, wherein:

said rotating disk extractor further comprises a weir in said tank for controlling a mud level in said tank.

9. A system according to claim 7, wherein:

air flowing through said air inlet and through said tank flows countercurrent to said mud flowing through said mud inlet and through said tank.

10. A system according to claim 7, wherein:

said gas capturing means comprises a Venturi ejector operatively coupled to said return line, wherein said Venturi ejector includes means for pulling air through said Venturi ejector to cause pressure at an atmospheric opening of said bell nipple to be less in said bell nipple than the pressure outside said bell nipple, wherein at least a portion of a mixture of said liberated gas and air from said bell nipple are received at said at least one gas analyzing means.

11. A system according to claim 10, further comprising:

(d) a plurality of flowrate measurement means for measuring a first rate of flow of said liberated gas-air mixture, and a second rate of flow of said extracted gas-air mixture, wherein said means for obtaining at least some of said mud includes determining means for determining a third rate of flow of said at least some of said mud into said rotating disk extractor, and wherein from said measured first and second rates of flow, said determined third rate of flow, knowledge of a fourth rate of flow of said mud exiting said borehole, and from an analysis of said liberated gases and said extracted gases, said gas analyzing means provides said quantification of said gases exiting said borehole.

12. A system according to claim 11, further comprising:

(e) mixture control means for receiving said liberated gas-air mixture and said extracted gas-air mixture and mixing said liberated gas-air mixture and said extracted gas-air mixture according to a predetermined relationship for sending to said at least on gas analyzing means.

13. A system according to claim 12, wherein:

said liberated gas-air mixture and said extracted gas-air mixture are mixed according to a ratio $F_{ac}F_s/(F_mF_{ae})$ to one, where $F_{ae}$ is said second flow rate, $F_s$ is said third flow rate, $F_m$ is said fourth flow rate, and $F_{ac}$ is said first flow rate.

14. A system according to claim 1, further comprising:

(d) mixture control means for mixing said extracted gas and said liberated gas according to a predetermined relationship for sending to said at least one gas analyzing means.

15. A system according to claim 14, wherein:

said predetermined relationship is a ratio $F_{ac}F_s/(F_m F_{ae})$ to one, where $F_{ae}$ is a flow rate of said extracted gases, $F_s$ is a flow rate of a sample of said drilling mud from which said extracted gases are extracted, $F_m$ is a flow rate of said drilling mud, and $F_{ac}$ is a flow rate of said liberated gases, and said mixture control means includes at least one valve means for directing at least a portion of at least one of said liberated gases and extracted gases such that said portion does not get mixed.

16. A method for quantitatively analyzing gases exiting a borehole with drilling mud, wherein said gases are released as at least one of liberated gases and at least one of entrained and dissolved gases in said drilling mud, said drilling mud exiting said borehole via a return line located adjacent a bell nipple atop said borehole, said method comprising:

(a) capturing a substantial amount of said liberated gases in said bell nipple and return line;

(b) extracting a substantial amount of said gases which are at least one of entrained and dissolved in said at least some drilling mud;

(c) analyzing said captured liberated gases and said extracted gases to provide a quantification of at least one of said gases exiting said borehole.

17. A method according to claim 16, wherein:

said capturing step comprises operatively coupling a Venturi ejector to said return line, causing said Venturi ejector to pull air through said Venturi ejector to cause pressure at an atmospheric opening of a bell nipple atop said borehole to be less in said bell nipple than the pressure outside said bell nipple, such that some air from said bell nipple and said captured liberated gases are pulled toward said Venturi ejector and consitute a captured liberated gas-air mixture, and said extracting step comprises obtaining said at least some drilling mud, introducing said at least some drilling mud into a rotating disk extractor means having a substantially enclosed tank with a mud inlet, a mud outlet, an air inlet, an air-extracted gas outlet, a rotatable shaft, and a plurality of disk means on said rotatable shaft, rotating said shaft such that said disks rotate and so that a mud film forms on said disks, introducing air through said air inlet, causing said air to contact said mud film and then leave said enclosed tank via said air-extracted gas outlet, such that obtained extracted gases are part of an extracted gas-air mixture.

18. A method according to claim 16, further comprising:

prior to analyzing said obtained captured and extracted gases, mixing said captured liberated gas and extracted gas according to a predetermined ratio of $F_{ac}F_s/(F_mF_{ae})$ to one, where $F_{ae}$ is a flow rate of said extracted gases, $F_s$ is a flow rate of a sample of said drilling mud from which said extracted gases are extracted, $F_m$ is a flow rate of said drilling mud, and $F_{ac}$ is a flow rate of said captured liberated gases.

19. A method according to claim 17, further comprising:

prior to analyzing said captured liberated gas-air mixture and said extracted gas-air mixture, mixing said captured-liberated gas-air mixture and said extracted gas-air mixture according to a predetermined ratio of $F_{ac}F_s/(F_mF_{ae})$ to one, where $F_{ae}$ is a flow rate of said extracted gas-air mixture, $F_s$ is a flow rate of said sample of said drilling mud from which said extracted gases are extracted, $F_m$ is a flow rate of said drilling mud, and $F_{ac}$ is a flow rate of said captured liberated gas-air mixture.

20. A method according to claim 16, wherein said quantification of gases provided by said analyzing step is done for a batch of gases, said method further comprising:

(d) finding in a continuous fashion the total hydrocarbon content of said gases; and (e) providing a continuous indication of gas quantities in said gases by interpolating results of quantification results obtained from analyzing steps on first and second batches of drilling mud.

21. A method according to claim 20, wherein:

said providing step interpolates results according to the relationship $$y_i2 = TH2\{(y_i1/TH1) - [(y_i1/TH1) - (y_i3/TH3)](t2-t1)/(t3-t1)\}$$

where TH1, TH2, and TH3 are total hydrocarbon content values at times t1, t2, and t3 respectively, $y_i1$ and $y_i3$ are concentrations of a gas component indexed as i at times t1 and t3, and $y_i2$ is an interpolated concentration of said gas component indexed as i at time t2.

22. A method according to claim 16, further comprising:

(d) correcting said quantification of gases obtained from said analyzing step according to a calibration technique utilizing at least one variable.

23. A method according to claim 16, wherein:

said at least one gas comprises a plurality of different hydrocarbon gases, and said at least one variable of said calibration technique comprises the carbon numbers corresponding to said different hydrocarbon gases.

* * * * *